US006089035A

United States Patent [19]

Mildengren

[11] Patent Number: 6,089,035

[45] Date of Patent: Jul. 18, 2000

[54] INTEGRATED MINI ICE SHEETS

[76] Inventor: Steve Mildengren, 6950 McLennan Ave., Van Nuys, Calif. 91406

[21] Appl. No.: 09/224,680

[22] Filed: Dec. 31, 1998

[51] Int. Cl.[7] ..... A63C 19/10

[52] U.S. Cl. ..... 62/235; 472/92

[58] Field of Search ..... 62/235; 472/92

[56] References Cited

U.S. PATENT DOCUMENTS

| | | | |
|---|---|---|---|
| 3,495,415 | 2/1970 | MacCracken | 62/235 |
| 4,038,834 | 8/1977 | Roberts | 62/235 |
| 4,497,483 | 2/1985 | Ahlgren | 62/235 |
| 5,331,826 | 7/1994 | Stockhaus et al. | 62/235 |
| 5,771,706 | 6/1998 | Lavigne | 62/235 |

*Primary Examiner*—William E. Tapolcai
*Attorney, Agent, or Firm*—Joel S. Wyenn

[57] ABSTRACT

The process of creating and maintaining an Integrated Mini Ice Surface is through the combination of a continuous pattern of copper pipe filled with freon covered with water connected to a series of thermostatic expansion valves which are connected to a 6 horse power condenser/compressor with a dehumidifier within the space which produces 3 mini ice surfaces. These ice surfaces allow an individual to practice or receive instruction in a confined shooting alley or lane which eliminates the risk of injury to another participant and the utility of quick ice hockey puck retrieval for continuous reuse.

2 Claims, 2 Drawing Sheets

N.T.S.

N.T.S.

N.T.S.

INTEGRATED MINI ICE SHEETS

CROSS REFERENCE TO RELATED APPLICATIONS not applicable

STATEMENT REGARDING FEDERALLY SPONSORED RESEARCH OR DEVELOPMENT not applicable

REFERENCE TO MICROFICHE APPENDIX not applicable

BACKGROUND OF INVENTION

This invention relates to:

1) a method of use of an ice surface
2) a process for the creation of three small interconnected ice sheets/surfaces of a pre-determined size
3) the application to both ice hockey skills practice as well as ice hockey skills instruction.

Historically, ice hockey practice and skills instruction have been conducted over the entire surface of a full size ice rink or ice arena or an open but not completely confined portion of the ice surface.

The difficulties encountered in the use of a full size ice rink or arena are:

1) the sizable expense to purchase time and space on the ice surface
2) problems in attempting to schedule the use of a portion of the ice surface for practice and skills instruction due to the need to have the full ice surface available for public use or skating lessons during specified times during the day and night
3) the difficulty in physically cordoning off a section of the ice surface which would be used for individualized practice and instruction in which a goal net would be situated
4) the inability of the upright surrounding border of the ice surface which is in place (referred to as boards) to confine the multitude of ice hockey pucks shot for quick and easy retrieval to be used over and over again
5) the possibility of interfering with or striking another person on the ice surface with an errant ice hockey puck shot or ricochet
6) the inability to be focused on the task at hand due to the open nature of the setting and the passive or overt actions of others in close proximity to the participants

BRIEF SUMMARY OF THE INVENTION

The best way to approach an understanding of this invention is to compare it to the sport of bowling. If the sport of bowling started out on one big surface and potentially two or more persons trying to practice or be taught the sport at the same time, potentially each person's individual activities would interfere with or be interfered by the other participant.

In order to solve that problem, the concept or idea of individual lanes (shooting alleys or shooting lanes) was conceived or invented so as to allow for:

1) an individual to play, practice or be taught the sport
2) have their activities confined to one area which would not interfere with another participant 3) remain in close proximity to others engaging in the same activity The objective of this invention is directed at solving the problem of obtaining a small confined area of ice surface for both ice hockey skills practice and skills instruction so as to:

1) keep confined the ice hockey pucks during their use where they are easily and quickly retrieved
2) where the shooter or goalie would not have to be concerned about injuring another participant in the next space By the use of the process to create three interconnected small ice sheets which become the lanes or alleys, the method of making/using lanes or alleys which are enclosed on all four sides with a suitable divider like structure and it's application to the practice and instruction of ice hockey skills, the user:

1) is no longer faced with the significant expense to purchase time for a portion of the ice surface which does not allow for non ice hockey use of the remainder of the ice surface
2) can eliminate scheduling problems due to the need for only a portion of the entire ice surface
3) will no longer have the problem of attempting to confine the ice hockey pucks to the training area
4) will have a small ice surface which will enhance the focus of the practice or training attempted

BRIEF DESCRIPTION OF SEVERAL VIEWS OF THE DRAWING

FIG. 1A depicts a sectional view of the ice sheet system and wall structure.

DETAILED DESCRIPTION OF THE INVENTION

Figure 1:
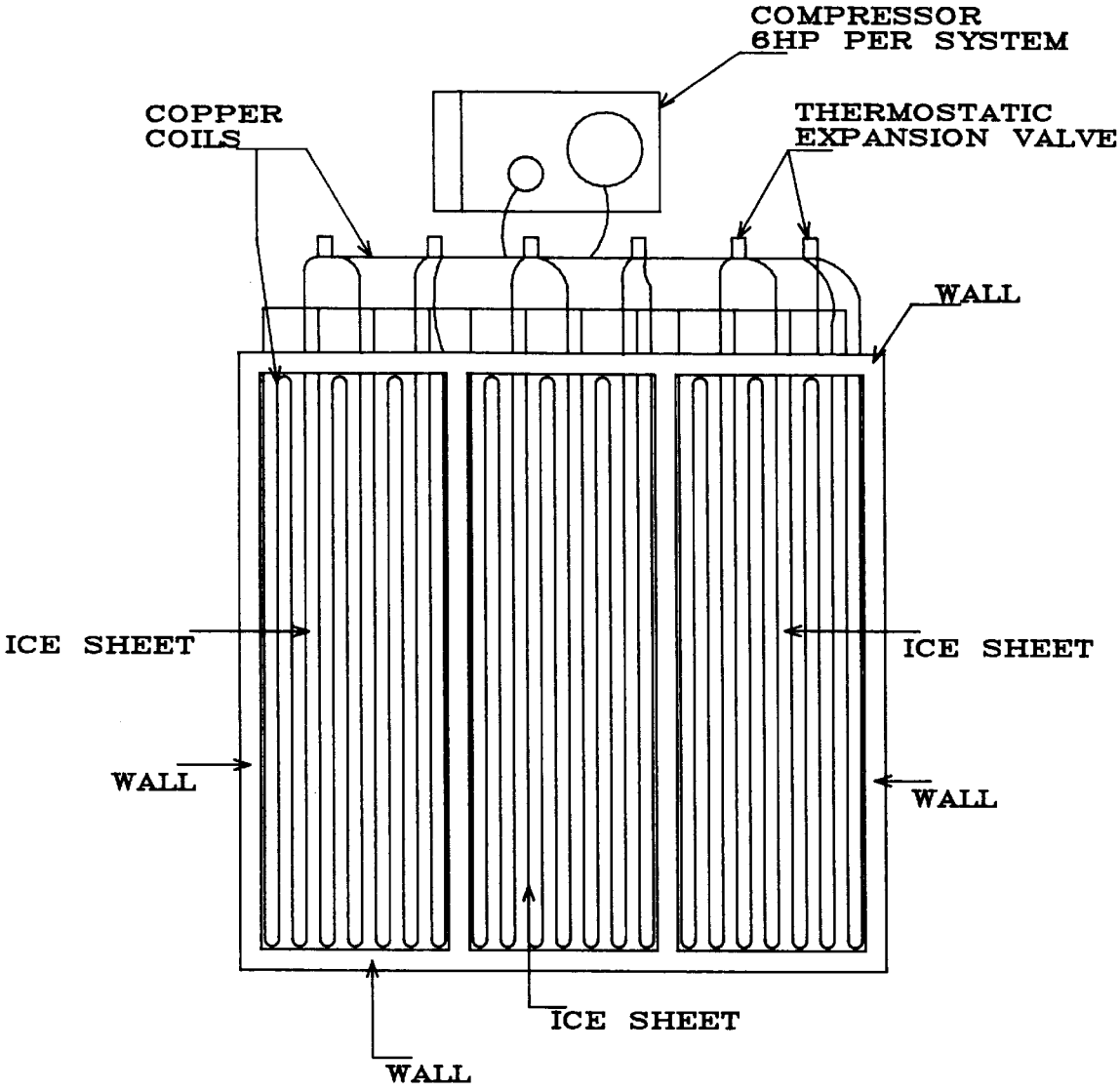
FIG. 1 depicts a frontal view of the three ice sheet system.
Figure 2:
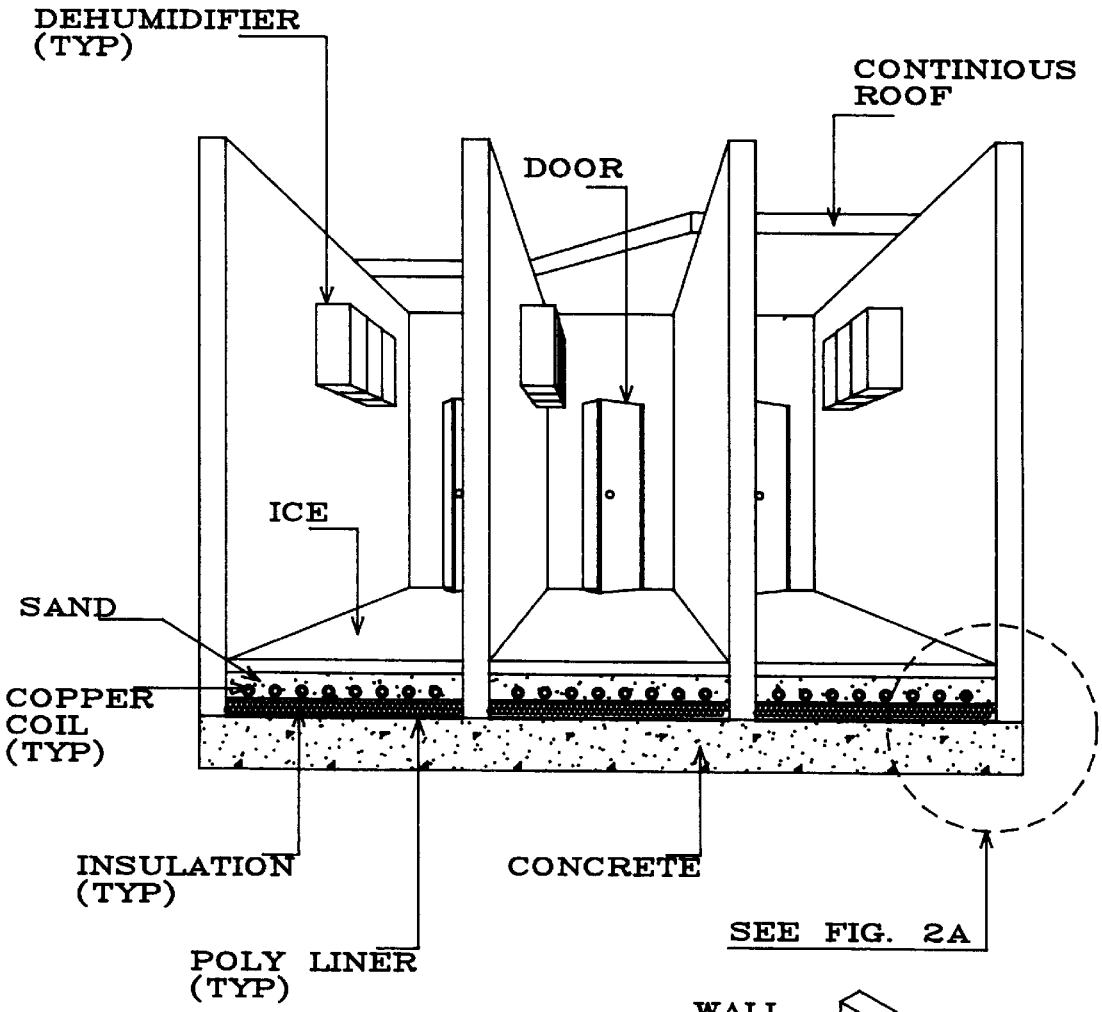
FIG. 2 depicts an overhead view of the three ice sheet system.
Figure 2A:
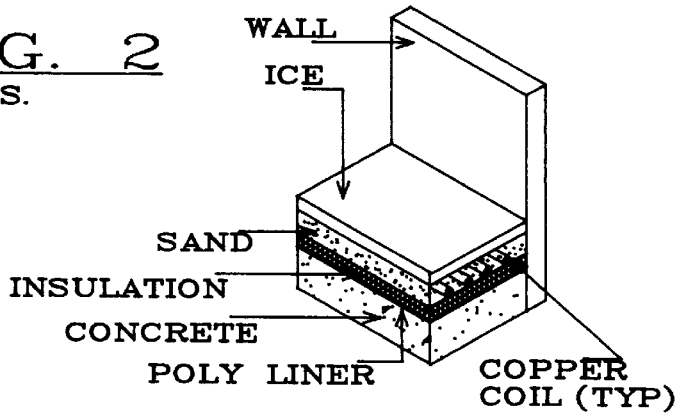

Referring to FIG. 1 the invention has three components:

1) a process of creating three small individually confined areas of ice surface by combining a continuous pattern of copper pipe connected to a series of thermostatic expansion valves which are connected to a 6 horse power condenser/compressor completing a closed system filled with freon. A dehumidifier is used as a component of the system/process but not connected directly to the other components. Each individual ice surface is constructed within a rigid free standing border of suitable material. Under the rigid free standing border is the following in order:
   a) a layer of concrete
   b) a layer of rigid thermal insulation
   c) a layer of plastic or poly sheeting
   d) a layer of sand
   e) a pattern of copper pipe filled with freon with interconnecting thermostatic expansion valves connected to a 6 horsepower condenser/compressor
   f) a layer of 1.5 to 2.0 inches of water
   g) the addition of a dehumidifier within the confines of the enclosed environment When the condenser/compressor is engaged, it causes the freon to pass through the copper piping and thermostatic expansion valves and return as air. This process of introducing the freon into the system/copper piping causes a freezing effect on the water surrounding the copper piping and in turn forms the ice sheet.

2) The method of use is by the creation of separate alleys or lanes in which practice and instruction are facilitated.

3) The application of this invention is to provide a individualized area for the purpose of practicing or the instruction of ice hockey skills with the ability to retain ice hockey pucks within the enclosed area for reuse in a quick fashion which facilitates continuous and better instruction.

What I claim as my invention is as follows:

1. An ice rink comprising:

(A) A bottom layer of concrete surrounded by a rigid free standing border;

(B) A plurality of dividers resting upon the concrete layer and arranged to provide a plurality of small, individually confined, free-standing and enclosed areas;

(C) Layers of thermal insulation, plastic sheeting, sand, and freezing pipes resting on the layer of concrete, the freezing pipes being connected to a refrigeration system;

(D) A layer of water which has been frozen by the refrigeration system into sheets of ice to create ice surfaces suitable for skating thereon;

(E) A dehumidifier disposed within each confined area;

whereby the small individually confined, free-standing, and enclosed areas created by the plurality of dividers enable one to practice or receive individual instructions in ice hockey skills without the fear of interference from individuals from an adjacent area.

2. The ice rink of claim 1 wherein three such confined areas are formed by the dividers.

* * * * *